United States Patent [19]

Franzer et al.

[11] 4,004,986

[45] Jan. 25, 1977

[54] FLUE GAS COLLECTOR FOR REGENERATIVELY-HEATED COKE OVENS

[76] Inventors: Wolfgang Franzer, Varenholzstrasse 17, 464 Wattenscheid; Hans Adamus, Kriemhildenstrasse 5, 43 Essen, both of Germany

[22] Filed: Jan. 30, 1975

[21] Appl. No.: 545,123

[30] Foreign Application Priority Data

Mar. 16, 1974 Germany ..... 2412749

[52] U.S. Cl. ..... 202/254; 202/263; 48/173; 137/798; 138/153; 432/180

[51] Int. Cl.[2] ..... C10B 27/00; C10J 3/82

[58] Field of Search ..... 202/254, 263, 111, 113, 202/123, 141; 176/87; 48/173, 190; 137/309, 372, 798; 138/153, 140, 172; 432/180, 181, 182

[56] References Cited

UNITED STATES PATENTS

| | | | |
|---|---|---|---|
| 2,515,814 | 7/1950 | Wilputte | 202/141 |
| 2,710,281 | 6/1955 | Weissenborn | 202/141 |
| 2,719,348 | 10/1955 | Desnos | 138/153 |
| 2,821,504 | 1/1958 | Doll | 202/141 |
| 2,873,231 | 2/1959 | Hiby | 202/141 |
| 3,005,469 | 10/1961 | Kenney | 138/153 |
| 3,309,286 | 3/1967 | Alderman | 202/254 |
| 3,586,059 | 6/1971 | Tanabe | 138/153 |
| 3,595,728 | 7/1971 | Robson | 176/87 |

*Primary Examiner*—Jack Sofer
*Attorney, Agent, or Firm*—Brown, Murray, Flick & Peckham

[57] ABSTRACT

A flue gas collector for coke ovens, particularly regeneratively-heated coke ovens, wherein the base, crown and side walls of the flue gas collector are formed from reinforced concrete in a generally rectangular cross-sectional configuration and are provided with insulating material on their interior surfaces. Additionally, insulating material is disposed between apertures in the flue gas collector and the ends of outlet pipes leading from changeover valves connected to the coke oven regenerators. The insulation is of such nature and thickness so as to insure that the reinforced concrete body of the collector assumes only negligible temperatures throughout, thereby eliminating cracks and leaks in the walls of the collector.

8 Claims, 3 Drawing Figures

FLUE GAS COLLECTOR FOR REGENERATIVELY-HEATED COKE OVENS

BACKGROUND OF THE INVENTION

As is known, in regeneratively-heated coke ovens, a flue gas collector main extends along a battery of coke ovens and is connected to the regenerators of the coke ovens by changeover valves. The bottom outlet pipes of the changeover valves extend into apertures in the crown of the flue gas collector and, hence, serve as inlets for the flue gases which pass along the collector to a discharge point.

In the past, it has been customary to construct these flue gas collector mains from refractory bricks which form a base, side walls and an arched crown. The refractory bricks are often encased within a concrete outer wall with or without the addition of an insulating layer. The concrete casing is sometimes also required to bear supports or other parts of the coke ovens, including those serving to brace and anchor the oven masonry.

The production of a brick arch of the type described above necessitates a considerable outlay in terms of labor and material. The component parts which have to be made in brick masonary on the one hand and in concrete on the other hand are dependent upon one another as regards their fabrication and this may give rise to considerable delays if there are any difficulties in the delivery of some of the materials. In addition, the concrete casing or shell is subjected to thermal stresses; and after a long period of operation, this results in cracks and leaks and, in particular, necessitates a high degree of reinforcement in order to insure the load-bearing capacity of the concrete material.

SUMMARY OF THE INVENTION

In accordance with the present invention, a new and improved flue gas collector main is provided which is substantially rectangular in vertical cross section and has a base, side walls and crown all formed from reinforced concrete provided on the interior surfaces thereof with thermal insulation whose wall thickness and characteristics are so selected that the reinforced concrete body assumes only negligible temperatures. The insulation permits the wall thicknesses of the base, side walls and crown to be much less than prior art flue gas collectors and requires considerably less reinforcement. Preferably, the insulation is of a type such that the reinforced concrete body at no time assumes temperatures above 100° C.

There are numerous materials available for the thermal insulation. In some instances they can comprise panels; and in this case the insulating layers lining the side walls and the crown can be inserted into the framework into which concrete is poured to form the collector. After the concrete has set, the insulating panels adhere thereto. Additional panels can be then secured to the interior of the base. There are also numerous insulating compounds available for spraying onto the base, side walls and crown after the concrete forming these elements has set.

In a flue gas collector of this type, ends of outlet pipes leading from changeover valves extend through apertures in the flue gas collector, usually apertures in the crown. Special care must be taken to insure that sufficient insulation is provided between the inner periphery of the aperture in the crown and the lower ends of the outlet pipes leading from the changeover valves. Preferably, a flared socket pipe surrounded by insulation is inserted into the crown aperture. The bottom of the outlet pipe from a changeover valve is then inserted into the top, flared portion of the socket pipe. The two parts are connected so as to be sealed; and a thermal insulating material is provided between the bottom of the outlet pipe and the flared upper end of the socket pipe. Advantageously, the bottom outlet pipe of the changeover valve bears by claws directly on the reinforced concrete body crown.

The above and other objects and features of the invention will become apparent from the following detailed description taken in connection with the accompanying drawings which form a part of this specification, and in which.

Figure 1:
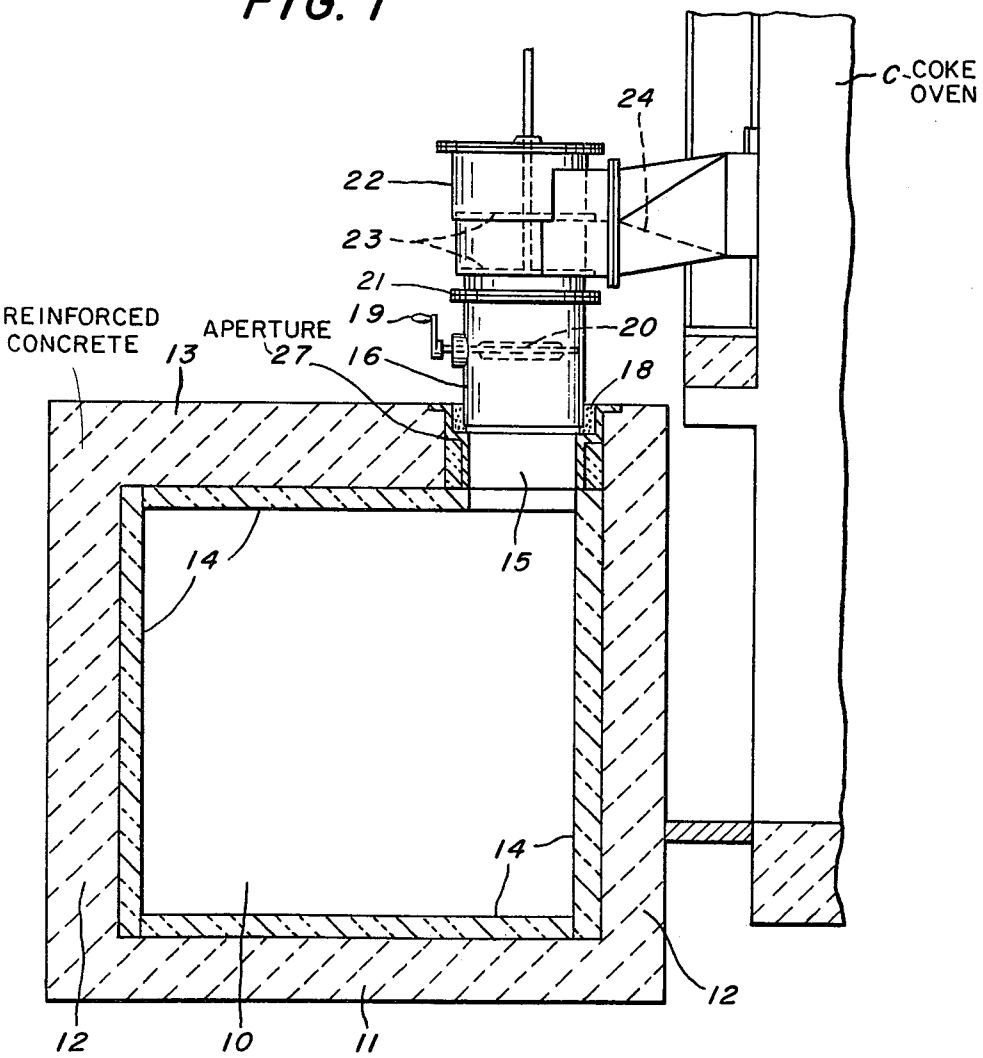
FIG. 1 is a vertical section through the flue gas collector main of the invention showing a changeover valve connected to the main.

With reference now to the drawings, and particularly to FIG. 1, there is shown diagrammatically the end portion of a coke oven C and particularly the regenerator cells of such a coke oven. The flue gas collector main is indicated generally by the reference numeral 10 and serves to carry away the gases which are burned in the coke oven firing system and which flow from the regenerator sole flues of the coke oven C through junction boxes 24 into one of two chambers in a valve housing 22. These can be closed or opened by raisable and lowerable plates 23 within the valve housing. The valve housing 22 is connected, by a bottom flange 21, to a similar flange on an outlet or junction pipe 16. A throttle valve 20 is provided within the junction pipe 16 and can be adjusted to any desired angular position by means of a handle 19. The junction pipe 16 terminates above an aperture 27 formed in the crown 13 of the reinforced concrete body forming the flue gas collector main 10.

The reinforced concrete body forming the flue gas collector main 10 consists of a bottom slab 11, side walls 12 and the crown 13. Reference 14 denotes an insulating layer which can be constructed from individual panels and which seals the reinforced concrete body from heating by the flue gases. In the case where the insulating layer 14 is formed from panels, the panels can be embedded in formwork during the fabrication of the walls 12 and crown 13. After fabrication of the reinforced concrete body, insulation of the bottom slab 11 can be effected by sticking the panels onto the concrete. Alternatively, the side walls and the crown of the reinforced concrete body can be fabricated initially without insulation and the insulation can subsequently be sprayed onto the bottom slab 11, side walls 12 and crown 13.

In the case where panels are used, the insulating material can comprise asbestos, aluminum silicate or asbestosfree calcium silicate. The asbestos, for example, incorporates a heat-resistant binder such as an alumina cement or waterglass which can withstand temperatures up to 400° C. Where the insulation is sprayed, it can comprise a pasty mass of calcium silicate and a suitable heat-resistant binder.

Figure 2:
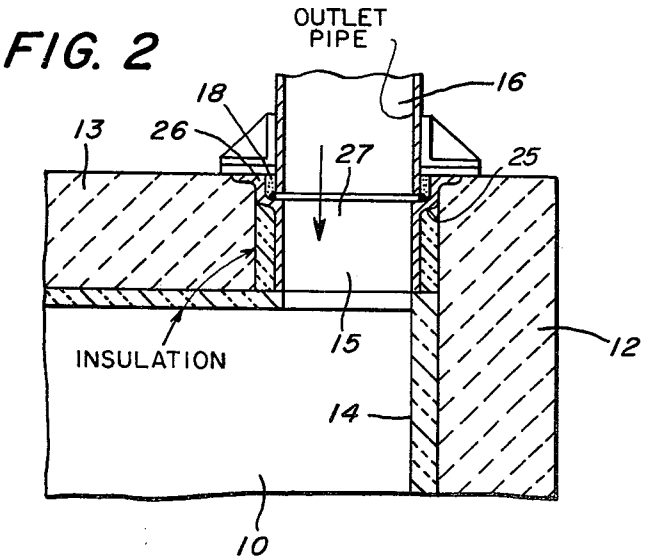
FIG. 2 is an enlarged broken-away portion of the illustration of FIG. 1 showing the construction of the crown aperture and socket pipe used for introducing flue gases into the flue collector from a changeover valve.
Figure 3:
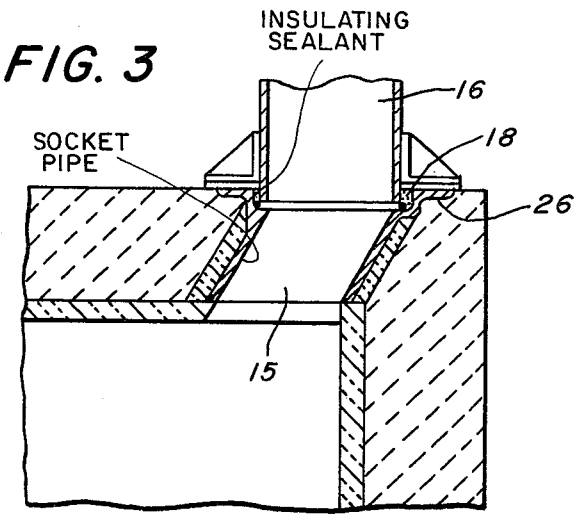
FIG. 3 is an illustration similar to that of FIG. 2 but illustrating a different embodiment of the crown aperture.

As is best shown in FIGS. 2 and 3, the aperture 27 receives a socket pipe 15. It may consist of an insulating material, such as ETERNIT (Trademark) or may be surrounded by a thermally insulating layer. The socket pipe 15 has a flared neck portion 25 and a collar 26 which rests on the crown 13. The lower end of the outlet or junction pipe 16 leading from the changeover valve is inserted into the flared neck part 25, the two parts being sealed to be gas tight by a thermally insulating sealant 18. This may comprise, for example, an asbestos cord which is pressed in place and then covered with a suspension of asbestos in waterglass or alumina cement. In the embodiment of the invention shown in FIG. 2, the crown aperture 27 extends along a vertical axis; whereas in FIG. 3 it extends along an axis which is at an angle with respect to vertical. In this case, the socket pipe has an angularly inclined lower shank portion as shown.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In a coke oven installation, a flue gas collector which extends along a battery of coke ovens and to which regenerators are connected by changeover valves, said flue gas collector comprising a base, crown and side walls formed from reinforced concrete, apertures in said flue gas collector and socket pipes fitted therein adapted to receive the discharge ends of outlet pipes leading from said changeover valves, and insulating material lining the interior wall surfaces of said base, crown and side walls and between the inlet ends of said socket pipes and said discharge ends of the outlet pipes, the nature and thickness of said insulating material being such that said reinforced concrete at no time during oven operation exceeds a temperature of 100° C.

2. A flue gas collector according to claim 1 characterized in that said socket pipes have flared gas inlet ends into which are inserted said discharge ends of said gas outlet pipes, and a thermally insulating sealant interposed between said discharge ends of said gas outlet pipes and said flared ends of said socket pipes.

3. A flue gas collector main according to claim 2 wherein the socket pipe is formed from insulating material.

4. A flue gas collector main according to claim 2 including insulation surrounding said socket pipe in said aperture.

5. A flue gas collector according to claim 1 wherein said insulating material is sprayed onto said interior wall surfaces.

6. A flue gas collector according to claim 1 wherein said insulating material is in the form of panels secured to said interior wall surfaces.

7. A flue gas collector according to claim 6 as is produced by inserting said panels into framework for said reinforced concrete before concrete is poured therein, whereby the panels will adhere to the concrete after it has set.

8. A flue gas collector according to claim 1 wherein said insulating material is selected from the group consisting of asbestos, aluminum silicate and calcium silicate.

* * * * *